US007805856B2

(12) United States Patent
Gaβmann et al.

(10) Patent No.: US 7,805,856 B2
(45) Date of Patent: Oct. 5, 2010

(54) DEVICE FOR DRYING LAUNDRY BY MEANS OF A CURRENT OF AIR

(75) Inventors: Jörg Gaβmann, Dresden (DE); Roman Goldberg, Dresden (DE); Kai Nitschmann, Neuenhagen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 662 days.

(21) Appl. No.: 11/593,977

(22) Filed: Nov. 6, 2006

(65) Prior Publication Data

US 2007/0107250 A1 May 17, 2007

(30) Foreign Application Priority Data

Nov. 16, 2005 (DE) ..... 10 2005 054 684

(51) Int. Cl.
*F26B 19/00* (2006.01)

(52) U.S. Cl. ..... 34/85; 34/82; 34/300; 34/371; 34/480

(58) Field of Classification Search ..... 34/82, 34/85, 138, 140, 292, 300, 371, 480
See application file for complete search history.

(56) References Cited

U.S. PATENT DOCUMENTS

| | | | | | |
|---|---|---|---|---|---|
| 1,429,519 | A | * | 9/1922 | Meyer | 19/217 |
| 1,791,574 | A | * | 2/1931 | Pauly | 34/569 |
| 2,570,437 | A | * | 10/1951 | Ellis | 34/547 |
| 4,991,038 | A | * | 2/1991 | Grant et al. | 360/85 |
| 6,413,287 | B1 | * | 7/2002 | Barber, Jr. | 51/298 |

FOREIGN PATENT DOCUMENTS

| | | | |
|---|---|---|---|
| DE | 82 24 528 U | | 2/1983 |
| DE | 8224528 U | * | 2/1983 |
| DE | 92 12 226 U | | 11/1992 |
| DE | 44 03 183 | | 8/1995 |
| DE | 4403183 | * | 8/1995 |
| DE | 198 42 644 | | 3/2000 |
| EP | 1 050 619 | | 11/2000 |
| GB | 2 350 416 | | 11/2000 |

* cited by examiner

*Primary Examiner*—Kenneth B Rinehart
*Assistant Examiner*—Corey Hall
(74) *Attorney, Agent, or Firm*—James E. Howard; Andre Pallapies

(57) ABSTRACT

A device for drying laundry by means of a current of air includes a drum to accommodate the laundry and a ducting system to direct the current of air. The ducting system has a section arranged downstream of the drum in which a filter is arranged to capture lint from the current of air. A scraper is movably mounted over the filter. This filter is a channel arranged in an approximately horizontal manner and in the form of an inverted arch. The scraper has a foil resting on the filter in a sprung manner, the scraper being curved in accordance with the shape of the channel. Moving the scraper along the longitudinal axis of the filter scrapes lint off the filter and into a collection reservoir.

20 Claims, 5 Drawing Sheets

DEVICE FOR DRYING LAUNDRY BY MEANS OF A CURRENT OF AIR

Figure 1:
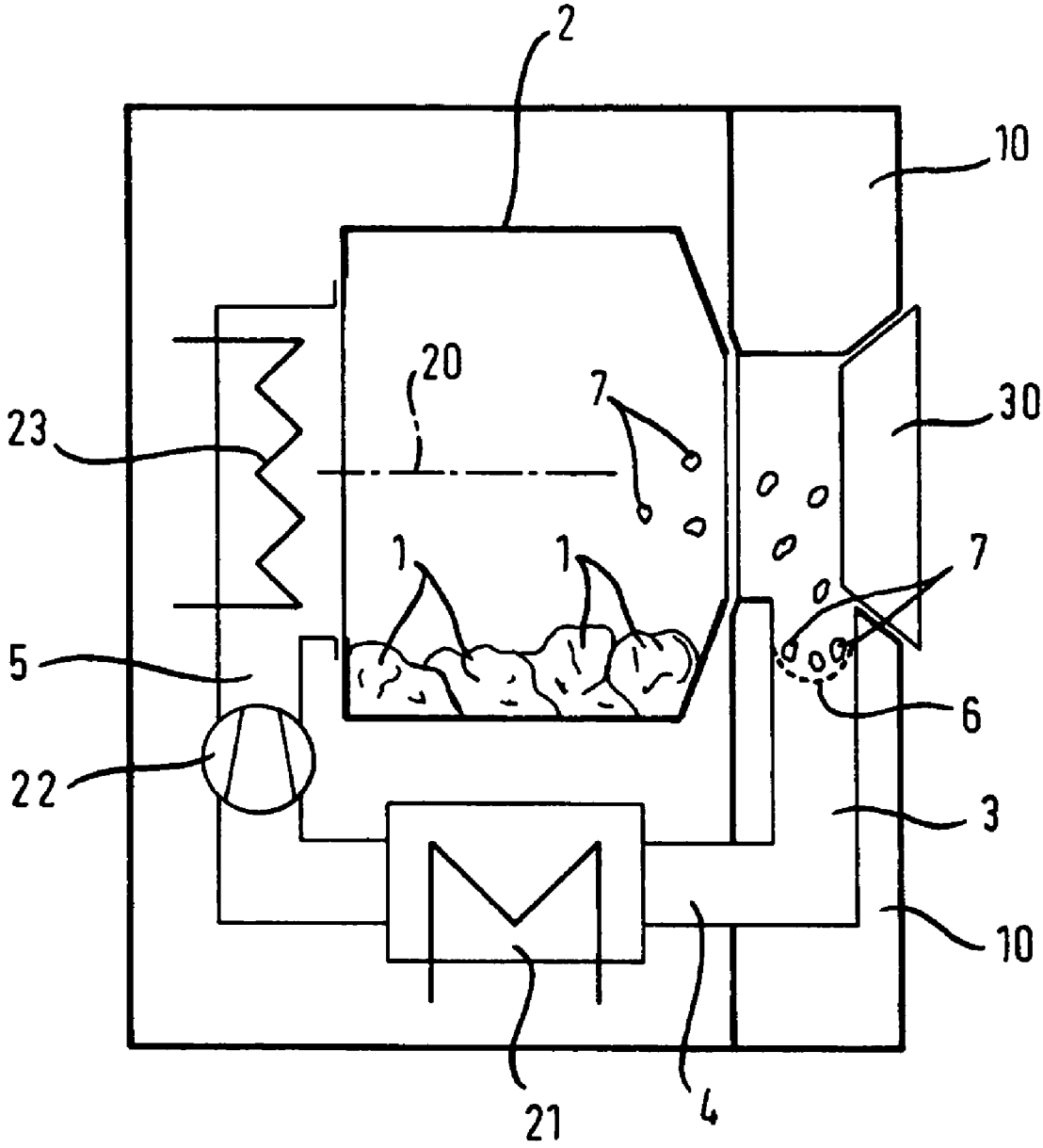

The invention relates to a device for drying laundry by means of a current of air, comprising a drum to accommodate the laundry and a ducting system to direct the current of air, the ducting system having a section arranged on the downstream side of the drum, in which the air current is directed in a downward direction, and within which is located a filter to remove lint from the current of air and a scraper to clear lint trapped by the filter and a receptacle with an opening to take the lint thus scraped off said filter.

A device of this kind is known from EP 1 050 619 B1 and DE 44 03 183 C2 respectively. The device in accordance with these documents incorporates a flat filter, which serves to catch lint dislodged and conveyed by a current of warmed air during the drying of the laundry, which is agitated in a rotating drum. The lint trapped by the filter must be removed at regular intervals, in order that the resistance to the current of air provided by the filter is sufficiently low, thus preventing the drying of the laundry being impaired. To this end, each device is provided with a scraper, which is periodically actuated, in order to scrape the trapped lint from the filter. According to EP 1 050 619 B1 the filter is embodied as part of a continuous belt, and, when driven by a motor, can be moved past the fixed scraper with its entire effective length. The lint thereby scraped off the filter is collected in a reservoir. According to DE 44 03 183 C2, the filter is embodied as a fixed surface, and is traversed by a movable scraper in order to remove the lint trapped; the scraper is connected to a closure mechanism for the door of the tumble dryer by means of an appropriate transmission, so that the scraper is passed across the filter every time the door is opened. The disclosure of both publications is incorporated by reference herein.

EP 0 997 571 B1 relates to a method for monitoring the current of drying air in a household tumble dryer and a correspondingly developed household tumble dryer. Here, a means to measure and monitor the speed of the stream of drying air is provided for. An undesirably high resistance to the current of air is thus detected and indicated by a suitable alarm. The main cause for such an increase in resistance to the current of air is lint, which is collected in appropriate components of the dryer. According to DE 199 24 297 A1, a household tumble dryer is provided for, with a self-cleaning lint filter, corresponding sensor equipment and an appropriately developed control mechanism, in order to enable the detection of an unacceptably high level of resistance to the air current at the lint filter during a drying process, and to rectify this by effecting self-cleaning of the lint filter. The disclosure of both publications is incorporated by reference herein. Each of the devices described in the cited publications EP 1 050 619 B1 and DE 44 03 183 C2 is characterized in that it has systematized the cleaning of the filter through removal of the trapped lint, so that impairment of the drying process is largely excluded, and consistently good results from the drying process ensured. Each of the devices described is, however, advantageous both in terms of the mechanical systems employed and of the costs involve.

Accordingly, the invention to be described below is based on the object of creating a device of the type cited in the introduction, which can manage with simpler and lower-cost mechanical systems than each of the known devices.

The object is achieved by a device for drying laundry by means of a current of air, comprising a drum to accommodate the laundry and a ducting system to direct the current of air, the ducting system having a section arranged on the downstream side of the drum, in which the air current is directed in a downward direction and in which is arranged a filter to capture lint carried in the current of air, according to the invention the filter being a channel arranged in an approximately horizontal manner and in the form of an inverted arch, and the scraper having a foil resting against the filter in a sprung manner and curved according to the shape of the filter.

The invention is based on the knowledge that in the case of regular cleaning of the filter, a filter may be used which displays markedly lower space requirements compared with a filter of the prior art, thus permitting the use of a comparatively simple and compact scraper. The filter, which in a device of the prior art must occupy a comparatively large area, approximately corresponding to the full opening of the drum, is redesigned as a comparatively compact component, in the form of a channel, which in particular below a loading aperture of the drum, can be arranged in the door of an otherwise conventionally designed tumble dryer. As a result of the form, the filter is more stable and can be simply and reliably cleaned with a correspondingly shaped scraper.

Compared with a flat filter, the form selected for the filter provides a significantly increased surface area, and thus offers relatively low resistance to the current of air flowing through it. The cross section of the channel is here of lesser importance, a primarily smooth cross section, in particular more or less corresponding to a conical curve has proved to be sensible and fit for purpose.

The foil preferably rest on the filter at an acute angle, in order to improve the dislodging of the lint, which adheres to the filter in a more or less stubborn manner.

Likewise preferably, that section of the ducting system through which the current of air must flow in a downward direction, passes through an end plate, which on the one side provides a support structure for a frontal panel of the device and a frontal support for the drum, and on the other side bears a door for closure of the drum.

Also preferably, a drive mechanism comprising a motor and a transmission is assigned to the scraper, the motor being capable being controlled by a control apparatus of the device. Also preferably, the transmission is a drive band in the manner of a steel band, as used in a customary roll-up measuring tape. Such a drive band is cambered across its length, and is particularly flexible in a plane perpendicular to this, stability being fully retained under tensile and pressure strain in the longitudinal direction. Accordingly, the drive band can be used to drive a cradle belonging to the scraper and carrying the foil, without a separate guide being required for the drive band. Limited remaining buckling strength contributes to the inherent safety of this drive, because the drive band can buckle and relieve the load on the motor if the scraper should become jammed upon encountering an unexpected obstruction during its travel. Transmission of the drive power from the motor to the drive band can be effected by means of a sprocket wheel directly driven by the motor which engages in corresponding sprocket holes in the drive band. To improve the functional safety of the drive band, corresponding smoothing of its surface, in particular by burnishing and/or coating it with a lubricant such as PTFE, is of additional benefit.

The foil of the scraper is preferably segmented into a large number of tongues which rest against the filter. In this way, excessive transverse tensions in the foil as a result of adjustment to the surface of the channel are avoided, and the functional safety of the foil is increased. Taking account of the properties of the material selected for the foil, a length of between 5 mm and 15 mm for each tongue has proved beneficial, as has a distance of max. 0.5 mm between two immediately adjacent tongues. A foil thickness of between 50 um and 250 μm has proved to be beneficial. The foil preferably consists of a material from a group including stainless steel, ceramic, coated ceramic and polymers, in particular polyamide and polyimide. For a foil comprising stainless steel, a thickness of between 50 μm and 100 μm has proved useful, and for a foil made of polyimide, a thickness of between 100 μm and 250 μm. The primary deciding factor in selecting the material for the foil is its suitability for sufficiently long usage in a warm and moist atmosphere, a high degree of elasticity coupled with low relaxation under tension and low water absorption being correspondingly important.

A further preferred embodiment of the device is characterized in that the scraper has a rest position at a first end of the channel, and that a chute is provided for at a second end of a channel to accommodate scraped-off lint, a wiper arrangement to scrape off lint adhering to the foil being further provided at the second end of the channel. This has the advantage that the foil is freed of any adhering lint at the end of each scraping process, so that the scraper is largely prevented from becoming clogged. The wiper arrangement preferably comprises a number of teeth or bristles, which in each case penetrate the gaps between immediately adjacent tongues of the foil. The bristles can here be provided in the form of a brush covering the complete cross section of the channel.

It is also preferable that the filter is mounted on a grid-like filter support. This serves to take up the spring forces which the foil exerts on the filter, thereby reducing strain on the filter.

Figure 2:
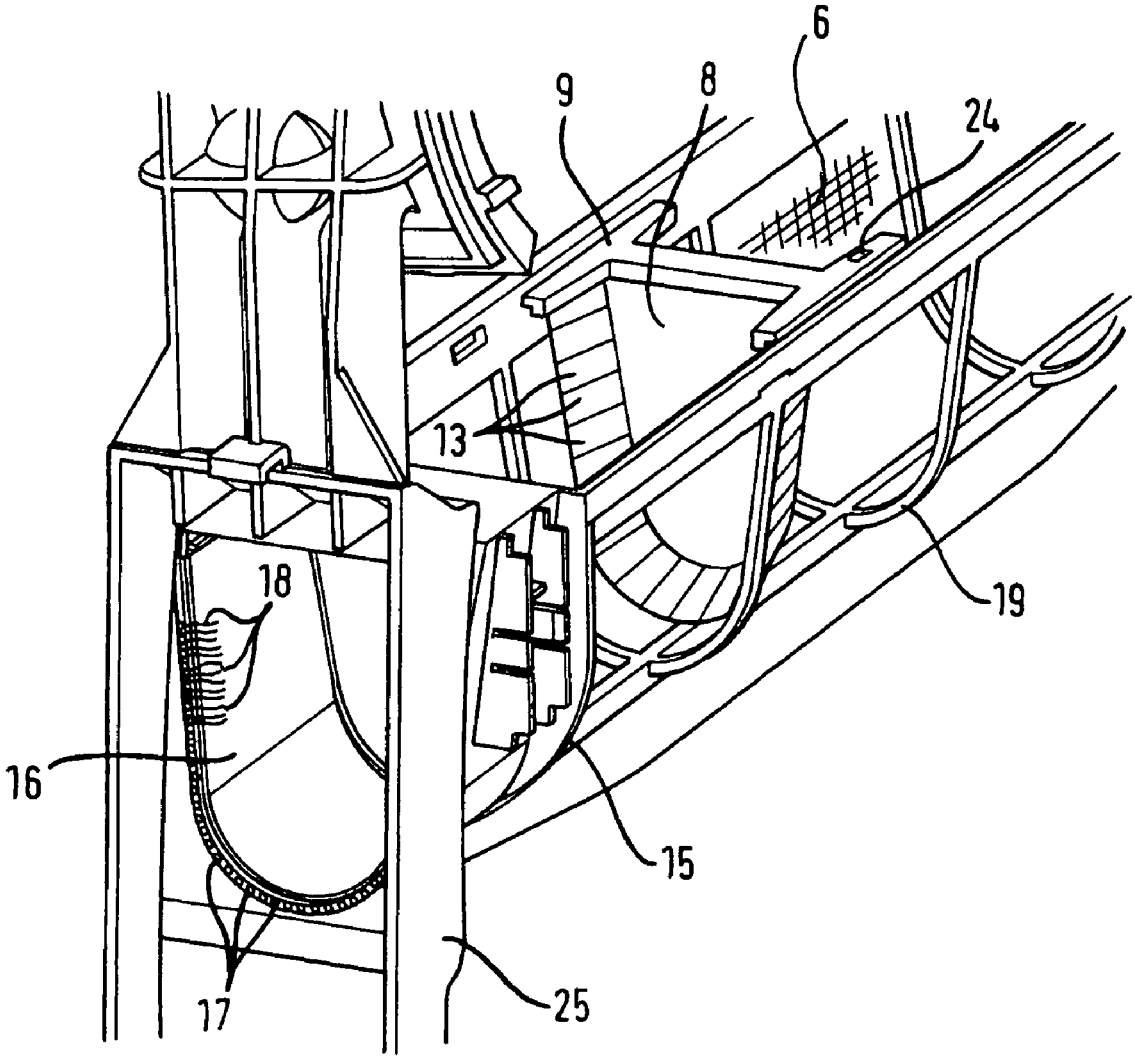
Figure 3:
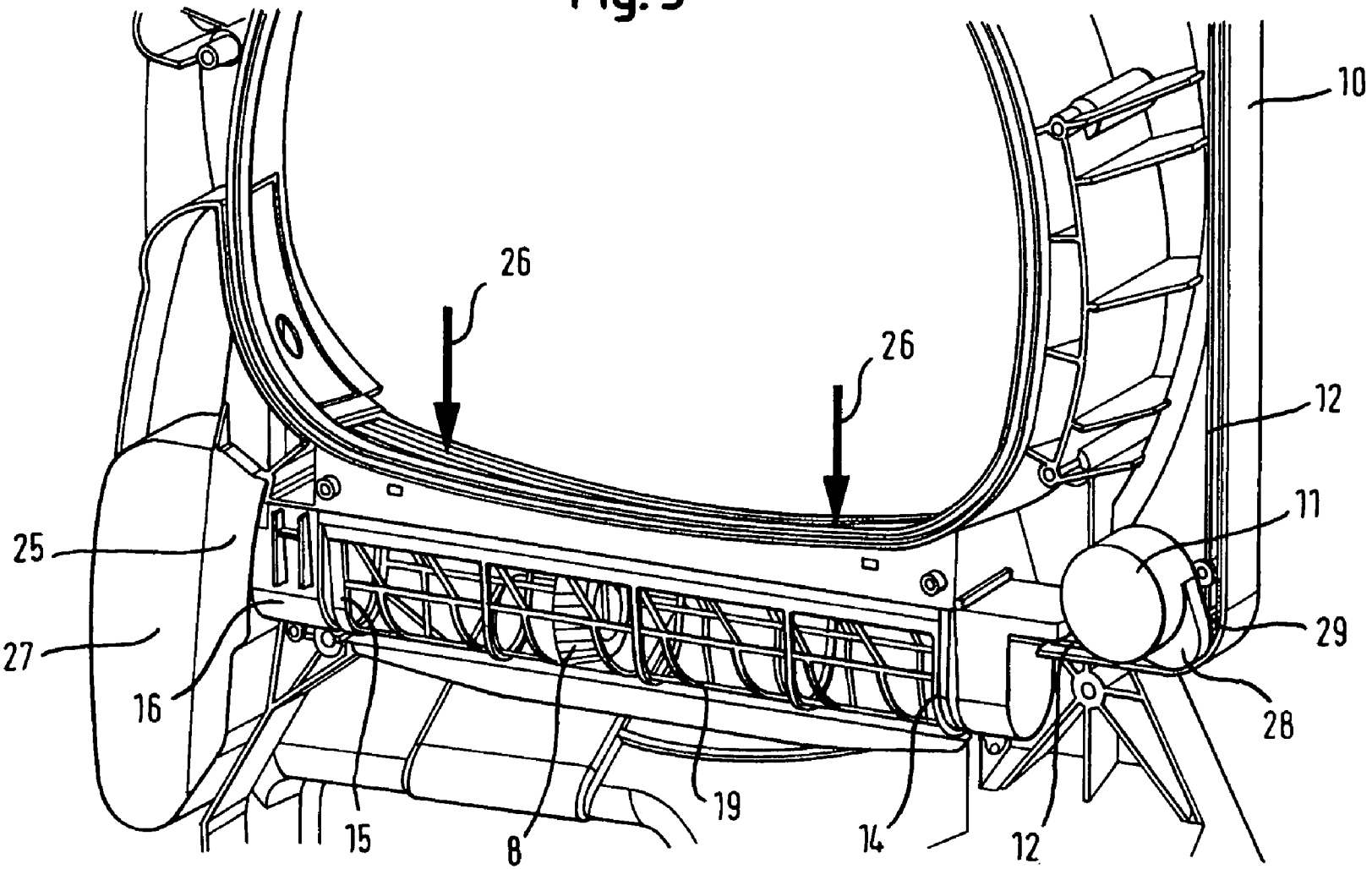
Figure 4:
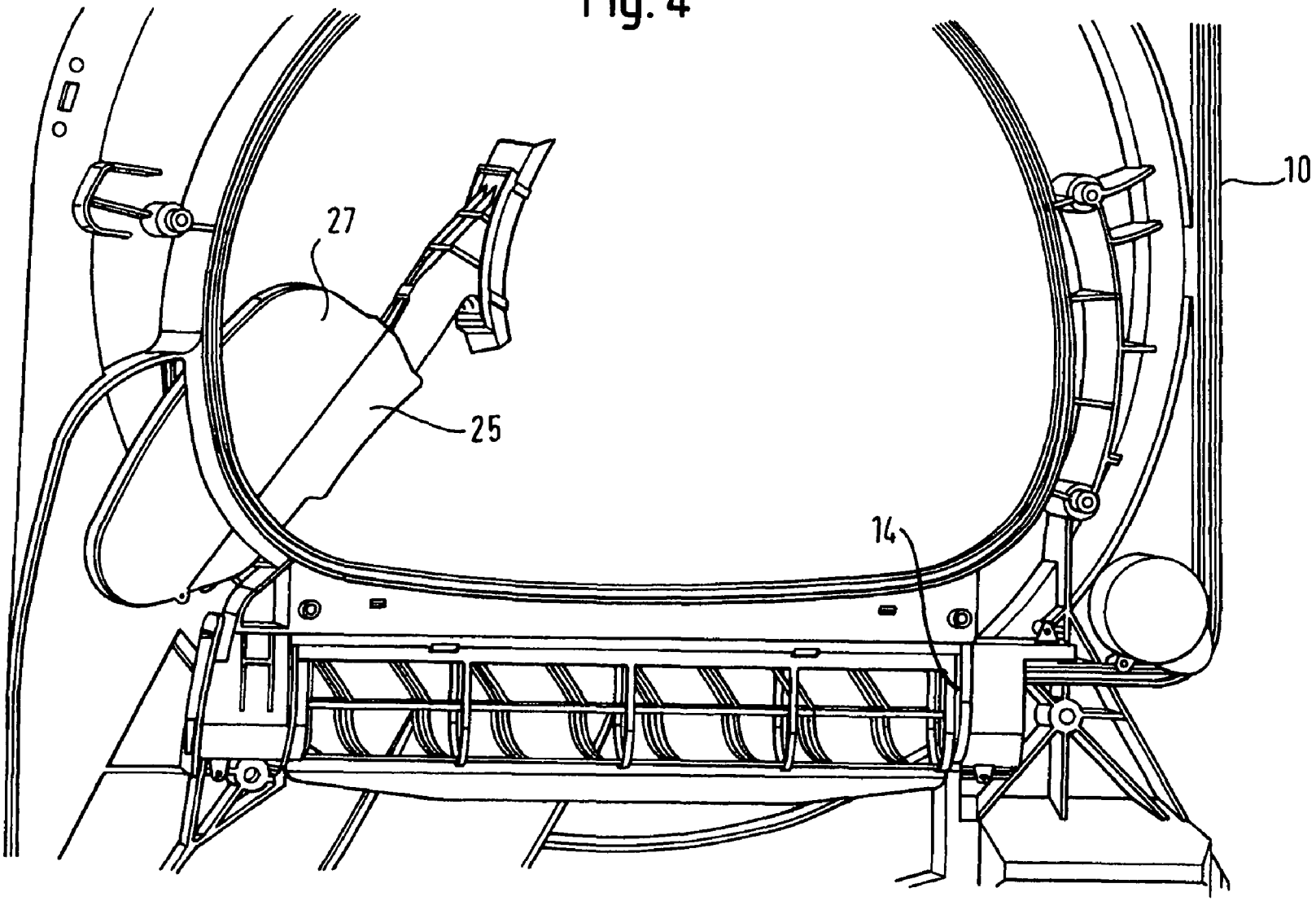
Figure 5:
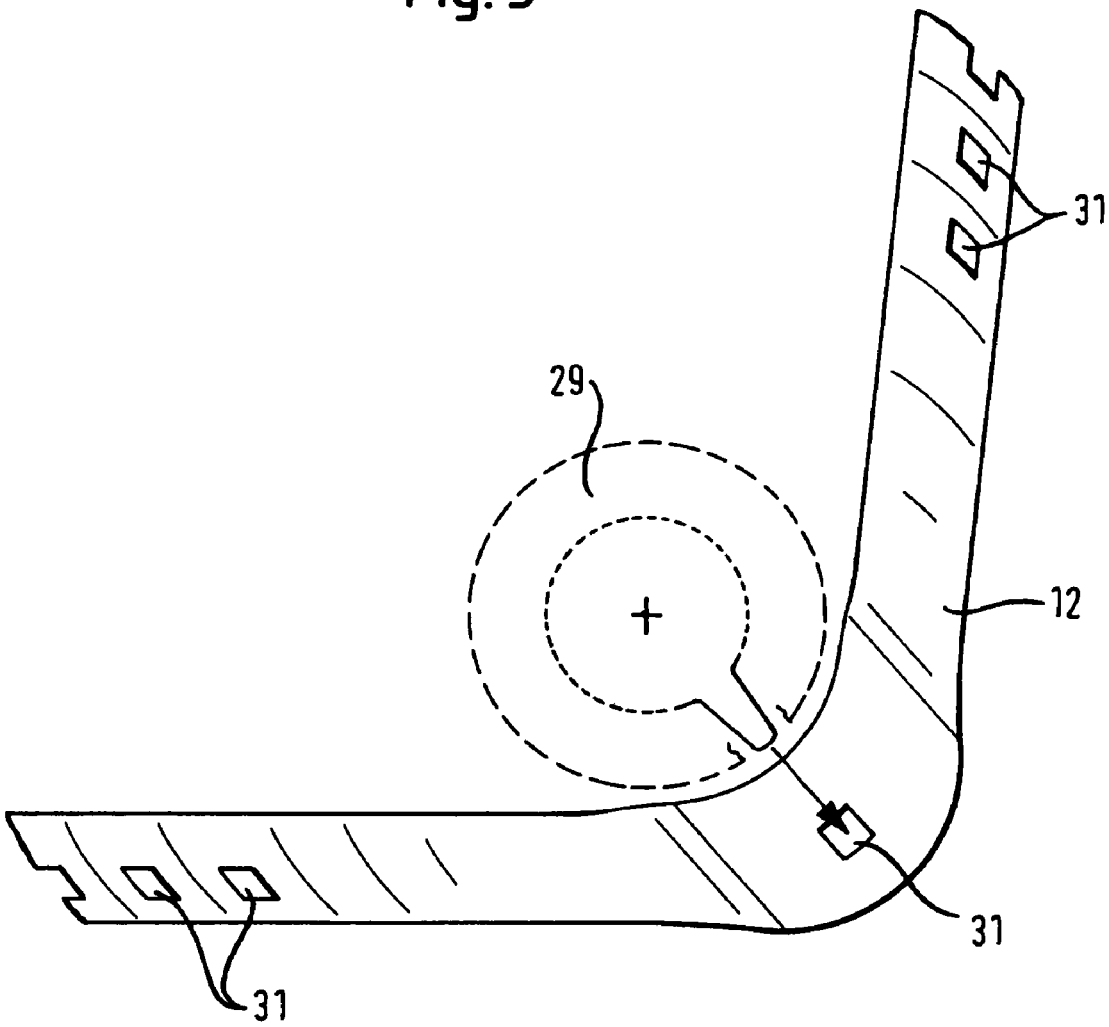

Exemplary embodiments of the invention are explained below on the basis of the drawing. The individual figures are as follows:

FIG. 1 A schematic cross-section through a tumble dryer;

FIG. 2 A view of a filter with a scraper for scraping off lint trapped in a tumble dryer;

FIG. 3 A partial view of an end plate of a tumble dryer, provided with a filter and a scraper and a receptacle to accept scraped-off lint;

FIG. 4 A partial view of an end plate of a tumble dryer, as in FIG. 3, but with a reservoir moved out of its latched position;

FIG. 5 A drive band with sprocket holes, driven by a sprocket wheel.

The respective parts of the tumble dryer in each case bear the same reference number in all figures.

According to FIG. 1, the device for drying laundry 1 by means of a current of air, comprises a drum 2 to accommodate the laundry 1, the drum 2 being capable of rotation around an axis 20, in order to agitate the laundry 1 in the current of air. The current of air is directed out of the drum 2 in a ducting system 3, 4, 5 and redirected into it once more. The ducting system 3, 4, 5 comprises a downward section 3, part of which passes through an end plate 10 for loading of the drum 2, a horizontal section 4 underneath the drum 2 and an upward section 5, through which the current of air reenters the drum 2. The downward section 3 contains a filter 6, which is arranged in the end plate 10, and by means of which the lint 7, which the current of air loosens from the laundry 1, is trapped. Using means not represented in FIG. 1, lint 7 thus trapped can be scraped off the filter 6, in order to ensure that the filter 6 presents the least possible resistance against the current of air. A heat exchanger 21 is provided for in the horizontal section 4 which follows the downward section 3, in which the steam conveyed in the current of air is cooled down and condensed. By known means not represented in FIG. 1, the condensed water is separated out of the current of air and disposed of. In the upward section 5 which follows the horizontal section 4 are a fan 22, which drives the current of air through the drum 2 and the ducting system 3, 4, 5, and a heating apparatus 23, via which the current of air is warmed once more prior to entering the drum 2. The heat exchanger 21 and the heating apparatus 23 can, if appropriate, belong completely or partially to a recuperative heat exchange system, in particular a heat pump. The end plate 10 forms on one side a support structure for a front panel of the device and a frontal support for the drum 2, and on the other side a door 30 for closing the drum 2.

FIG. 2 shows a detailed view of the device outlined in FIG. 1, comprising a filter 6, curved to form a channel, mounted on a filter support 19, and shown only in part for the sake of clarity. Across the filter 6 passes a scraper 8, 9 comprising a foil 8 resting on the filter at an acute angle, and a cradle 9 carrying the foil 8, which is movable on corresponding rails on the filter support 19. With the aid of this foil 8, lint trapped by the filter 6 can be scraped off the filter 6, and directed into a chute 16 to one side of the filter 6, from or in which it is transferred to a reservoir 25, shown only in part in FIG. 2, for storage and eventual removal.

The foil 8 rests on the filter 6 by way of a number of tongues 13; attention is here drawn to the above remarks on advantageous dimensions and selection of material for foil 8. In the vicinity of a second end 15 of the filter 6, where the chute 16 is also located, is a wiper arrangement 17, 18 for scraping off lint 7 adhering to the foil 8. This wiper arrangement 17, 18 is made up of teeth 17 and/or bristles 18. The wiper arrangement 17, 18 serves to remove lint 7 adhering to the foil 8, in order to prevent the clearance of lint 7 from the filter 6 being impaired.

Operation of the scraper 8, 9 to clear trapped lint 7 from the filter 6 beneficially takes place by means of a suitable drive (see here FIGS. 3 and 4), and in each case at the end of a drying process performed in the device. As desired and as required, this clearance can also take place on a number of occasions during a drying process, it being possible to ascertain corresponding requirements if applicable by means of suitable sensor system (detection of an unwanted loss of pressure through the filter 6 within the current of air) in an essentially known manner and with essentially known means.

FIG. 3 shows the seating of the filter 6 and of the filter support 19 in the end plate 10 of the tumble dryer. The end plate 10 is here viewed from within the drum 2. Having left the drum 2, the current of air passes into the end plate 10 in the direction of the arrow 26, thus reaching the filter 6, which for the sake of clarity is not shown, on the filter support 19. There, the lint carried along by the current of air is filtered out. The trapped lint is removed by the scraper 8, 9, by movement of the latter from a first end 14 of the filter to a second end 15, driven by a motor 11 and a transmission comprising a cambered drive band 12. This lint thereby scraped off passes into the chute 16 and the reservoir 25, 27. The drive band 12 is provided with sprocket holes in a manner which is not shown, and is driven by the motor 11, via a sprocket wheel 29 partially covered by a cover 28 (see also FIG. 5). This drive band 12 has the advantage of inherent stability, which makes the provision of special guidance superfluous, and is also stable if the foil 8 should occasionally become snagged; the drive band 12 can prevent a correspondingly excessive load occurring, by buckling. Connection of the drive band 12 and the cradle 9 (see FIG. 1) is effected in particular in that a lug or screw connection on the drive band 12, and not shown here, engages in a corresponding recess 24 in the cradle 9.

The reservoir 25, 27 can be removed from the end plate 10, as indicated in FIG. 4. In this way, the collected lint 7 can be removed relatively simply and conveniently, avoiding the unpleasant task of scraping lint off a filter 6, as hitherto necessary with customary tumble dryers. The scraper 9 is not visible in FIG. 4, as upon removal of the reservoir 25, 27, which must necessarily take place at a time when the door 30 (cf. FIG. 1) is open, and accordingly no drying process is in progress, it is in its rest position in the vicinity of the first end 14.

FIG. 5 shows a detailed view of the drive band 12 already mentioned. Its straight sections are cambered, that is to say they demonstrate a certain camber, said camber disappearing in a reversible manner when the drive band 12 is buckled. The drive band 12 is provided with sprocket holes 31, which are only shown in part and with which the sprocket wheel 29, of which only one tooth is represented, engages, as indicated by the arrow. For the sake of clarity, the drive band 12 and the sprocket wheel 29 are depicted at a distance from each other in FIG. 5. The drive band 12 is guided around the sprocket wheel 29 via an area approximately corresponding to a right angle. Thanks to its inherent stability of form, with the exception of one kinking point it can be guided largely without special guide mechanisms, making its use in the tumble dryer described in the present document advantageous.

The invention claimed is:

1. A device for drying laundry, the device comprising:

a drum receiving the laundry;

a ducting system guiding a current of air, said ducting system having a section downstream of the drum, in which the current of air is directed downwardly;

a filter disposed within the section and for capturing lint carried in the current of air from the drum;

a scraper disposed adjacent the filter to clear trapped lint, wherein the filter includes a channel arranged in an approximately horizontal manner and in the form of an inverted arch and oriented with an upward facing arch opening and the scraper having a curved foil resting on the filter in a sprung manner and curved according to the shape of the channel, and wherein the scraper has a rest position at a first end of the channel, the scraper being movable in a linear direction from the first end of the channel to a second end of the channel to scrape lint off of the filter.

2. The device according to claim 1, wherein the foil can rest on the filter at an acute angle.

3. The device according to claim 1, wherein the section passes through an end plate and the filter is arranged in the end plate.

4. The device according to claim 1, wherein the filter bears on a filter support having multiple apertures therein.

5. The device according to claim 1, further comprising a drive device comprising a motor and a transmission assigned to the scraper.

6. The device according to claim 5, wherein the transmission includes a drive band.

7. The clothes dryer according to claim 6, wherein a first end of the drive band is coupled to the scraper, wherein sprocket holes are formed in the drive band, and wherein projections on a sprocket that is coupled to the motor interacts with the sprocket holes of the drive band to move the drive band back and forth in linear directions.

8. The clothes dryer according to claim 7, wherein a second end of the drive band extends in a direction that is perpendicular to the first end which is coupled to the scraper.

9. The device according to claim 1, wherein the foil includes a plurality of tongue segments around the periphery of the foil contacting the filter.

10. The device according to claim 9, wherein each tongue segment has a length between 5 mm and 15 mm.

11. The device according to claim 9, wherein each tongue segment has a width of between 3 mm and 15 mm.

12. The device according to claim 9, wherein two immediately adjacent tongue segments are at most 0.5 mm apart.

13. The device according to claim 9, wherein the foil is composed of a material from a group comprising stainless steel, ceramic, coated ceramic and polymers.

14. The device according to claim 9, wherein the foil has a thickness of between 50 μm and 250 μm.

15. The device according to claim 9, further comprising:

a chute located at a second end of the channel to receive scraped-off lint; and a wiper arrangement mounted at the second end of the channel, the wiper arrangement removing lint from the foil.

16. The device according to claim 15, wherein the wiper arrangement comprises a plurality of teeth or bristles penetrating the gaps between two immediately adjacent tongue segments to remove lint from the tongue segments.

17. A clothes dryer comprising:

a housing;

a drum disposed within the housing and mounted for rotation with respect to the housing;

a fan generating an air flow through the dryer and a ducting system guiding the air flow, the ducting system including a section disposed downstream from the drum and upstream from the fan;

a filter support having a plurality of apertures therethrough disposed within the section and a filter mounted on the filter support for capturing lint, the filter and filter support forming a channel having a substantially U-shaped cross-section and oriented with an upward facing channel opening and extending in a direction substantially transverse to the air flow through the section; and a scraper supported by the filter support for movement with respect to the filter, the scraper including a curved foil having a substantially U-shaped cross-section corresponding to the shape of the filter, the foil being disposed within the channel and contacting the filter to remove lint from the filter as the scraper moves in a linear direction along a longitudinal axis of the channel with respect to the filter.

18. The clothes dryer according to claim 17, further comprising a drive device disposed near a first end of the channel and including a motor driving a sprocket wheel and a drive band including multiple holes for receiving the sprocket wheel, the drive band being connected to the scraper and moving the scraper in a linear direction in response to rotational movement of the sprocket wheel.

19. The clothes dryer according to claim 17, further comprising a wiper arrangement disposed near a second end of the channel being opposite the first end, the wiper arrangement including projections for clearing lint from the foil.

20. The clothes dryer according to claim 19, further comprising a chute and a reservoir disposed near the second end of the channel for receiving and storing the lint.

* * * * *